US005461834A

United States Patent [19]

Carlberg

[11] Patent Number: 5,461,834

[45] Date of Patent: Oct. 31, 1995

[54] SOLARIUM PANEL CAP

[76] Inventor: Stanley B. Carlberg, 676 Ashland Ave. West, St. Paul, Minn. 55102

[21] Appl. No.: 163,581

[22] Filed: Dec. 7, 1993

[51] Int. Cl.[6] ..... E04C 3/00

[52] U.S. Cl. ..... 52/466; 52/463; 52/468

[58] Field of Search ..... 52/461, 463, 464, 52/465, 466, 467, 468

[56] References Cited

U.S. PATENT DOCUMENTS

| | | | |
|---|---|---|---|
| 1,864,130 | 6/1932 | Gibian | 52/464 |
| 2,599,322 | 6/1952 | Drain | 52/467 X |
| 5,074,089 | 12/1991 | Kemmer et al. | 52/467 X |

FOREIGN PATENT DOCUMENTS

| | | | |
|---|---|---|---|
| 214120 | of 1961 | Austria | 52/468 |
| 2380405 | 10/1978 | France | 52/468 |

*Primary Examiner*—Carl D. Friedman
*Assistant Examiner*—Creighton Smith
*Attorney, Agent, or Firm*—Haugen & Nikolai

[57] ABSTRACT

A two-piece solarium panel cap comprised of a top and bottom member, wherein the bottom member is bridged across adjacent solarium panels to provide a water seal. The top member is selectively secured upon the bottom seal member to seal the fasteners from the environment. Both pieces can be comprised of resilient polyethylene material which is much less expensive than conventional aluminum or galvanized metal weather stripping. Further, the present invention is easy to use and can be manufactured in a variety of colors. Two embodiments are shown, one adapted for being disposed over an interface between two solarium panels, and a second embodiment adapted about a single solarium panel forming a corner of a solarium.

8 Claims, 3 Drawing Sheets

10
51
14
48
44
42
36
50
40
12
40
32
15
16
41
20
16
24
24
30
18

SOLARIUM PANEL CAP

FIELD OF THE INVENTION

This invention relates generally to solariums and more particularly to sealing strips disposed across an interface defined between a pair of solarium panels to insure moisture cannot seep between the panels.

BACKGROUND OF THE INVENTION

Solariums are becoming an increasingly popular building structure by homeowners today. While the designs of solariums are almost infinite and limited only by the imagination of the homeowner, the basic building materials of solariums are more limited. Basically, solariums are formed by a plurality of tinted glass panels secured to and supported by a frame comprising support beams or joists. Conventionally, weather stripping is provided above the gaps defined between adjacent solarium panels to inhibit water from seeping between the panels and into the solarium. Such weather stripping is typically comprised of aluminum or galvanized metal strips including seals and which are bridged between the ends of adjacent solarium panels. The weather stripping is then typically secured to joists disposed thereunder supporting the ends of the respective solarium panels. Typically, the metal weather stripping is secured to the joists by utilizing a variety of clamping devices, or hardware such as screws disposed therethrough and into the joist. A gasket or a resilient washer is provided with the fastening screw to minimize water seepage through the hole defined through the weather stripping.

The problem with conventional weather stripping is that aluminum and galvanized metal is relatively expensive material. For a typical solarium, several hundred feet of weather stripping is required. Thus, the cost of weather stripping contributes substantially to the cost of the overall solarium. Moreover, the hardware and the washer remain exposed to the elements which is aesthetically unappealing, and lends itself to a potential point of water intrusion. Providing a weather stripping which is easy to use and very affordable will significantly reduce the overall cost of a solarium, thus making a solarium more affordable for the average homeowner.

OBJECTS

It is accordingly a principle object of the present invention to provide a solarium panel cap having a cost significantly less than conventional aluminum or galvanized metal weather stripping.

It is a further object of the present invention to provide a solarium panel cap which is easy to use, is aesthetically pleasant when adapted above the interface between a pair of solarium panels, and which includes mounting hardware which is shielded from the elements.

Another object of the present invention is to provide a solarium panel cap which is adaptable to solarium panel interfaces on walls, roofs, or at corners of the solarium.

Still yet a further object of the present invention is to provide a solarium panel cap which can be manufactured in a plurality of colors to provide an aesthetically pleasant solarium.

Other objects and advantages of the present invention will be readily appreciated by one of ordinary skill in the art, wherein like numerals in the various figures refer to like elements.

SUMMARY OF THE INVENTION

The foregoing objects and advantages of the present invention are realized by providing a two-piece solarium panel cap, wherein a bottom member is bridged across the interface between a pair of solarium panels and are sealed thereto, and wherein a top member can be fastened to a top surface of the bottom member in a sealing covering relation to cover fastening members, such as screws, which secure the bottom member to a joist supporting the solarium panels. More specifically, the solarium panel cap is comprised of an elongated seal or bottom member having a top and bottom surface and a pair of ends defined along the length thereof. The bottom surface of the seal member has at least one first seal finger proximate each said end and is adapted to seal to the respective solarium panel when adapted thereupon. The bottom seal member further has an attachment portion defined on a top surface thereof. An elongated second or top cover member is provided having a securing portion securingly adaptable to the attachment portion of the bottom seal member in a covering relation therewith. Thus, in use, the bottom seal member can be bridged across the gap defined between a pair of adjacent solarium panels and secured to a joist thereunder using a plurality of screws disposed through the seal member and into the joist. The top cover member can then be attached to the top of the seal member in a covering relation therewith to seal the tops of the fasteners from the weather to minimize water leakage into the solarium, and to provide an aesthetically pleasant cap. The attachment portion of the bottom seal member is preferably comprised of at least one finger, and preferably a pair of elongated fingers in a butterfly arrangement. The securing portion of the cover member is preferably comprised of a recess defining a lip, which recess is preferably elongated and adapted to receive the attachment fingers of the seal member in a snap-like arrangement.

Preferably, the attachment finger or fingers of the bottom seal member extend a substantial length along the seal member top surface. Similarly, the recess and lip of the cover member also extend along a substantial length thereof. The bottom surface of the bottom seal member is provided with a plurality of the first seal fingers to establish multiple sealing contacts with the respective solarium panel to further reduce the chance of water seeping under the seal member and between the adjacent solarium panels. In a preferred embodiment, the longitudinal seal member has a web portion defined between each of the first seal finger or fingers such that the seal member can be flexed. Preferably, the seal member has a generally arcuate cross section.

In an alternative embodiment to the present invention, a solarium panel cap which is adapted above an end of a single solarium panel which is positioned over support joist is provided. In this embodiment, an elongated seal member is provided having a top and bottom surface wherein a single end is defined along a length thereof. The bottom surface has at least one seal finger proximate this end and is adapted to seal to the solarium panel when adapted thereupon. The seal member further has an attachment portion defined on a top surface thereof, similar to the attachment portion previously described for the cap adapted to be used across two adjacent solarium panels. Similarly, an elongated cover is provided having a securing portion adaptable to the attachment portion of the bottom seal member in a covering relation therewith, similar to the sealing cover member previously described. One further feature of this embodiment is a tail portion disposed opposite the seal finger and extending from the bottom seal member downward proximate the end of the solarium panel and adjacent the joist to further reduce the chance of moisture from advancing under the cap and into the solarium. The top cover member of both embodiments includes a second seal finger each side of the recess to provide a water seal between the cover and bottom member to reduce the chance of water seeping thereunder.

Still yet another embodiment comprises a solarium panel cap adapted to the roof edge of a solarium. This roof edge comprises a pair of solarium panels interfacing at the roof edge or corner. Thus, the present invention is adaptable to a variety of solarium panel configurations.

DESCRIPTION OF THE PREFERRED EMBODIMENT

Figure 1:
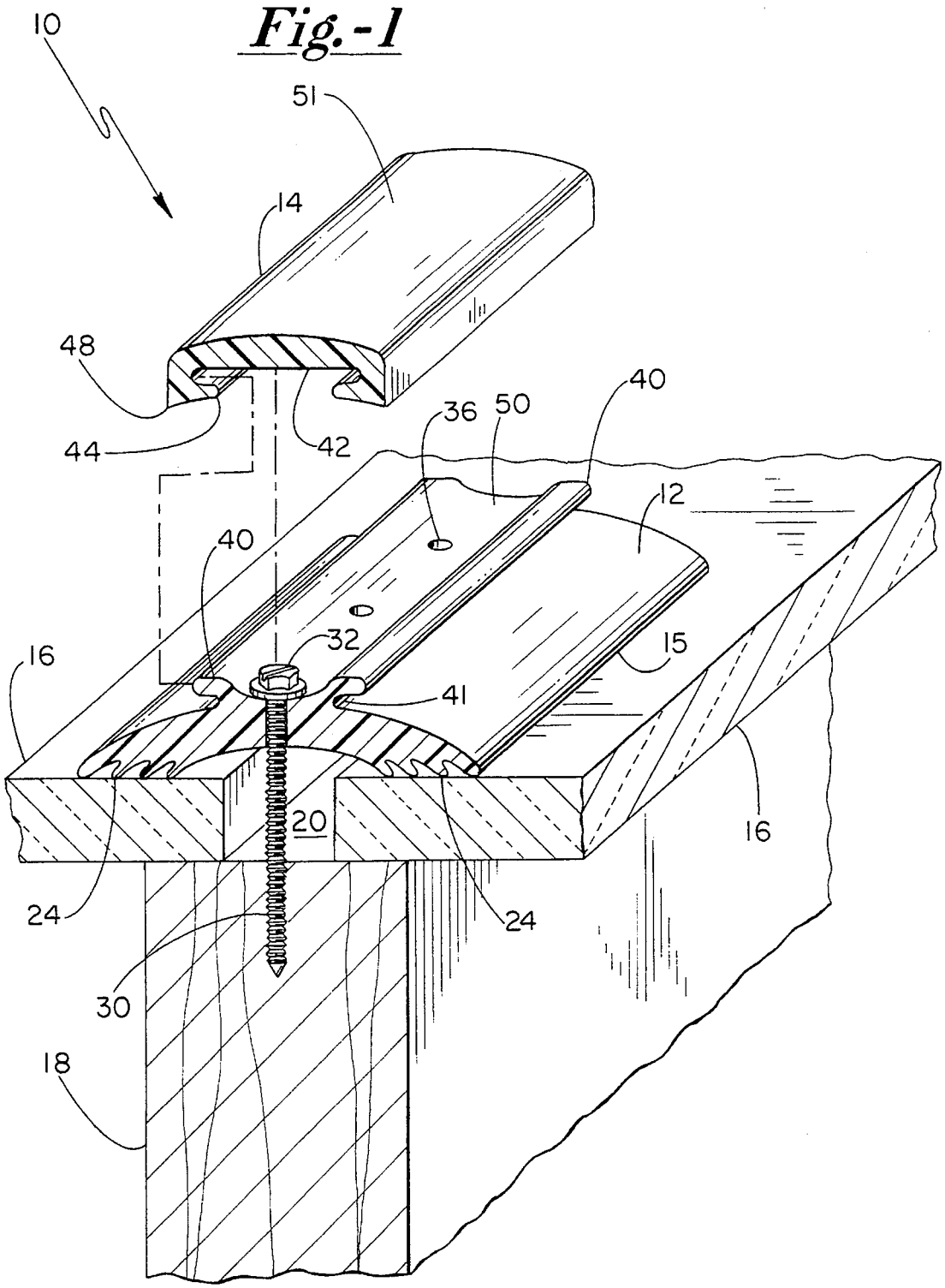
FIG. 1 is a partially exploded sectional perspective view of a joist cap arrangement according to the preferred embodiment of the present invention adapted across a gap defined between a pair of solarium panels positioned upon the support joist.

Referring to FIG. 1, a two-piece solarium panel cap assembly is generally shown at 10. Solarium panel cap 10 is comprised of a bottom seal member 12 and a top cover member 14 securingly adaptable thereupon. Most solariums are typically formed by arranging a plurality of tinted glass solarium panels 16 such that the ends terminate upon a support member or joist 18, as shown in FIG. 1. Thus, a gap 20 is defined between the adjacent panels 16 above support joist 18.

To reduce the chance of moisture, such as rain, from advancing into gap 20, under panel 16 and into the solarium constructed, bottom member 12 is provided. Bottom or seal member 12 is elongated defining a top and bottom surface, and a pair of ends or edges 15. Defined along each edge 15 is a plurality of fingers 24 having tapered tips. Bottom member 12 has an arcuate-shaped cross section, as shown, such that each of fingers 24 engage the respective panel 16 at an acute angle with respect to the adjacent solarium panels 16. The tip of each of fingers 24 makes a good liquid seal between bottom member 12 and the respective glass panel 16.

The bottom seal member 12 is secured in place above gap 20 and to the top surfaces of respective solarium panels 16 by disposing a plurality of fasteners, such as Phillips-head screws, shown at 30. Fasteners 30 are disposed through an otherwise water impermeable bottom member 12 and secured into joist 18 using a Phillips-head screwdriver or a similar fastening tool. Bottom seal member 12 is preferably comprised of polyethylene, thus, it is resilient and provides a good water seal against panels 16. Fasteners 30 are provided with a washer 32, and are torqued during installation to establish a good water seal at the tips of fingers 24, but are not over-tightened to minimize deforming bottom seal member 12. A plurality of uniformly spaced dimples 36 provided at a central location along the length of bottom member 12 to facilitate receiving a fastener 30. However, dimples 36 do not become perforations until a fastener 30 is disposed therethrough. Thus, bottom member 12 is water impermeable except where a fastener 30 is inserted therethrough. Implementing a washer 32 helps reduce the chance of moisture seeping through the holes created by fastener 30 disposed in dimples 36.

A second key member of the solarium cap is elongated top member 14 also comprised of resilient polyethylene. Top member 14 is adapted to be selectively secured to and about a pair of elongated fingers 40 defined the length of the bottom member 12 top surface. The profile of fingers 40 define a generally butterfly shape. Top member 14 includes an elongated oval recess 42 extending the length of the top member 14 bottom surface, and defines a pair of opposing elongated ledges or fingers 44. Top member 14 is flexed and selectively adapted to bottom member 12 by adapting recess 42 about the butterfly shaped fingers 40 such that fingers 44 are disposed in notches 41 defined between the respective finger 40 and the top surface of bottom member 12. This provides a good snap-like attachment. A further feature of top member 14 is a pair of elongated sealing fingers 48 defined by a pair of elongated tapering points. Fingers 48 each engage the top surface of bottom member 12 to provide a good liquid seal contact such that when top member 14 is adapted to bottom member 12, water from the environment cannot progress under fingers 48 and into channel 50 defined between the pair of butterfly fingers 40. Thus, water from the ambient cannot extend into channel 50 and through the apertures defined through bottom member 12 by fasteners 30. Thus, gap 20 defined between solarium panel 16 will remain water free. While an elongated pair of fingers 40 and an elongated recess 42 are preferred, it is to be recognized a plurality of fingers 40 could be defined at predetermined intervals with corresponding recesses 42 defined at predetermined intervals, and limitation to a continuous elongated finger 40 and recess 42 is not to be inferred.

Top member 14 has a rounded top surface 51, wherein the combination of top member 14 and bottom member 12 has a low-profile. Further, since both bottom members 12 and top member 14 are comprised of polyurethane, they can be manufactured to have a plurality of selected colors such that the solarium will have a pleasant aesthetic appearance. In combination, bottom members 12 and top member 14 provide a low cost alternative to prior art aluminum or galvanized metal weather stripping. Further, the combination is easy to use since bottom better 12 can be quickly adapted across gap 20 and upon each solarium panel 16, and secured to joist 18 using fasteners 30 in dimples 36. Top member 14 can be flexed and snapped upon bottom member 12 in a covering relation therewith to inhibit moisture from seeping to the holes defined through the bottom member 12. Wherein prior art metal stripping may comprise of a single strip of metal having gasket material and with an exposed fastener disposed therethrough, the present invention totally shields the fasteners from the environment to reduce the chance of moisture seeping therethrough.

Figure 2:
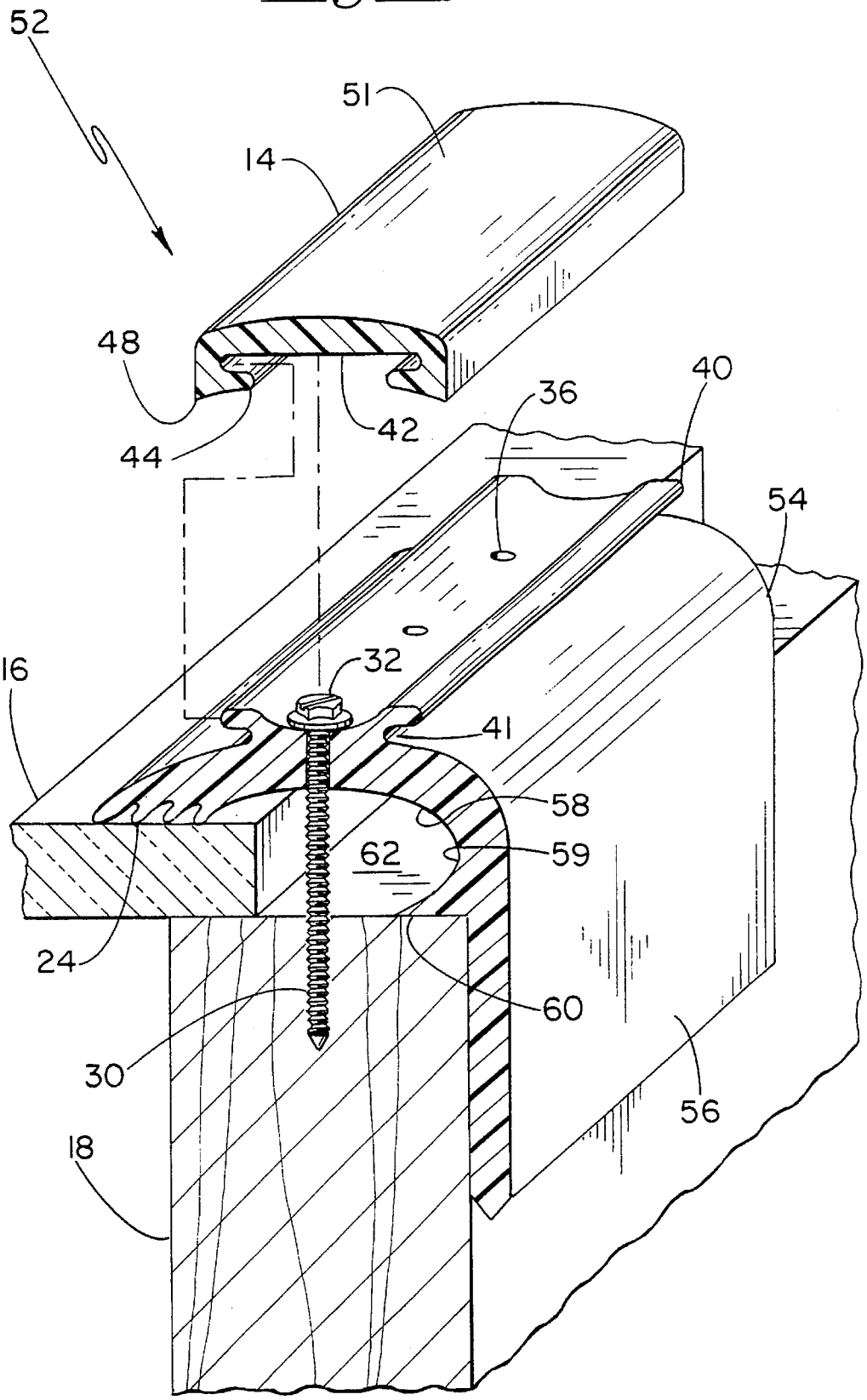
FIG. 2 is an alternative embodiment of the present invention illustrating a partially exploded sectioned solarium panel cap adapted upon a single solarium panel terminating upon a support joist, wherein the solarium panel cap is adapted to be used at solarium roof edges.

Now referring to FIG. 2, an alternative embodiment to the present invention is shown. In this embodiment, a two-piece combination solarium panel cap is shown at 52 which is adapted to the solarium roof edge and about a single solarium panel 16 terminating upon a joist 18, as shown. This combination solarium panel cap includes many of the same features of the two-piece solarium panel cap 10 shown in FIG. 1. The cover or top member 14 is identical and adaptable to both bottom members shown in the embodiments (FIGS. 1–2). However, a bottom member 54 is provided in this embodiment which has a plurality of tapered fingers 24 defined on a lower surface at one end, and a tail portion 56 defined opposite the fingers 24 and extending downward along the end of the solarium panel 16 and along joist 18 as shown. Tail portion 56 can be defined longer than shown, if desired, and serrated in the longitudinal direction to facilitate bending the tail under the bottom of joist 18 (not shown) for subsequent fastening thereto if desired. This feature further protects joist 18 from the weather. Bottom member 24 has an arcuate inner surface 58 extending and tapering to a shoulder portion 60 which abuts and conforms to the corner of joist 18 as shown. Inner surface 58 in combination with panel 16 and joist 18 defines an elongated cavity 62, wherein bottom member 56 has a narrower or webbed portion at 59 such that the thickness and material of bottom member 56 along with web 59 allows it to flex inwardly when fasteners 32 are tightened to obtain a good liquid seal. Otherwise, many of the features shown in bottom member 12 of FIG. 1 are present in this embodiment, namely, a pair of elongated butterfly-shaped fingers 40, a plurality of dimples 36 defined at predetermined intervals, a fastener 30 and washer 32, and a pair of elongated notches 41 defined under fingers 40.

When bottom member 54 is adapted about a single solarium panel 16 and joist 18 it provides a liquid seal between the engaging surfaces. Thus, bottom member 54 helps secure panel 16 to joist 18, and further, reduces the chance of any moisture from extending under fingers 24 and between the interface defined between panel 16 and joist 18. In this embodiment, both top member 14 and bottom member 14 are also comprised of polyethylene, are resilient, and can be comprised of a plurality of colors to provide an aesthetically pleasant weather stripping cap.

Figure 3:
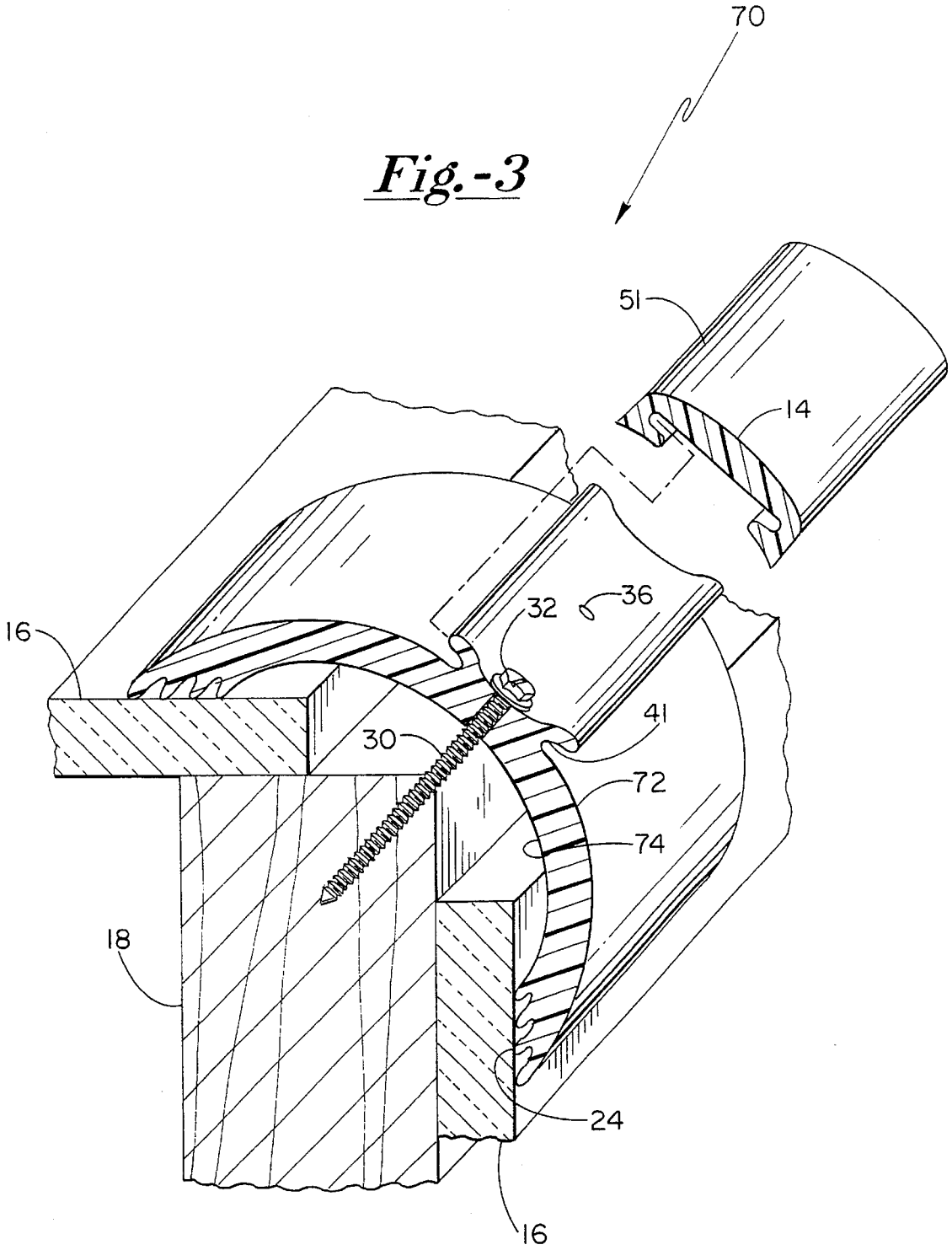
FIG. 3 is yet another alternative embodiment of the present invention adapted to a roof edge having a pair of solarium panels interfacing at the corner thereof.

Referring now to FIG. 3, yet another alternative embodiment of the invention is shown as two-piece cap 70. In this embodiment, the two-piece combination solarium panel cap 70 is shown adapted to a solarium roof edge and about a pair of solarium panels 16 terminating at adjacent edges upon joist 18, and at the corner of the roof as shown. This combination solarium panel cap also includes many of the same features of the two-piece solarium panel cap 10 and 52 shown in FIGS. 1 and 2. The cover or top member 14 is identical and also adaptable to both of the bottom members 12 and 56 shown in FIGS. 1 and 2. In this embodiment, a bottom member 72 is provided having a plurality of tapered fingers 24 at each end thereof. Bottom member 72 has an arcuate-shaped cross section arcuately extending 90°, as shown, such that each of fingers 24 sealingly engage the respective panels 16 at an acute angle with respect to the adjacent solarium panels 16. Thus, the tips of each fingers 24 makes a good liquid seal between bottom member 72 and the respective glass panel 16. Bottom member 72 is also comprised of resilient polyethylene, and is seen to include an inner arcuate surface 74, and having a moderate thickness. Accordingly, fasteners 32 adapted thereto and into joist 18 can slightly flex bottom member 72 to provide a good liquid seal between fingers 24 and the respective solarium panels 16. Bottom member 72 is slightly thinner between notches 41 and fingers 24 defined at the distal ends thereof. This creates a web at a mid-section therebetween to further facilitate flexure of bottom member 72 when fastened to panels 16 and joist 18, as shown.

In summary, three embodiments of a combination solarium panel cap are shown which are much less expensive than conventional aluminum or galvanized metal weather stripping. The top and bottom members forming the present invention can be easily manufactured using well-known extrusion techniques. Where the prior art weather stripping leaves the fasteners exposed to the elements, the present two-piece invention seals the fasteners from the ambient and the elements. The present invention is easy to use, and further, the top cover member 14 can be replaced after time if it becomes weathered or discolored, which replacement would be relatively inexpensive compared to the cost of replacing aluminum stripping. Thus, for years to come, the present invention is much less expensive than the prior art alternatives.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

I claim:

1. A solarium panel cap for sealing an interface defined between a pair of adjacent solarium panels, said interface being disposed atop a support joist, the cap comprising in combination:

(a) an elongated seal member having a length and a convex top surface and a concave bottom surface wherein said top and bottom surfaces terminate in a pair of ends having a plurality of flexible seal fingers integrally formed with said seal member along the length thereof, wherein said plurality of flexible seal fingers engage said respective solarium panel when said seal member is disposed thereupon, said seal member further having an attachment portion formed on said seal member top surface; and (b) an elongated cover member having a dove tail recess for receiving said attachment portion of the seal member, said cover member having a concave bottom surface which corresponds with and engages said convex top surface of the seal member when disposed thereupon.

2. The solarium panel cap as specified in claim 1 wherein said attachment portion includes a pair of attachment fingers extending above said seal member and adapted to fit within the dove tail recess.

3. The solarium panel cap as specified in claim 2 wherein said pair of attachment fingers are integrally formed with said seal member along the length thereof.

4. The cap as specified in claim 1 wherein said seal member has a cross section arcuately extending approximately 90 degrees to facilitate adaption to solarium roof edges.

5. A solarium panel cap for sealing an edge of a solarium panel relative to a support joist supporting said edge, the cap comprising in combination:

(a) an elongated seal member having a length and a convex top surface and a concave bottom surface wherein said top and bottom surfaces terminate in a solarium panel seal member edge having a plurality of flexible seal fingers integrally formed with said seal member along the length thereof, wherein said plurality of flexible seal fingers engage said solarium panel when said seal member is disposed thereupon, said top and bottom surfaces terminating in a joist engaging seal member end having a tail portion extending about the edge of the solarium panel and along a surface of the joist, said seal member further having an attachment portion formed on said top surface; and (b) an elongated cover member having a dove tail recess for receiving said attachment portion wherein said cover member has a concave bottom surface which corresponds with and engages said convex top surface when disposed thereupon.

6. The cap as specified in claim 5 wherein said attachment portion includes a pair of attachment fingers extending above said seal member and adapted to fit within the dove tail recess.

7. The cap as specified in claim 6 wherein said pair of attachment fingers are integrally formed with said seal member along the length thereof.

8. The cap as specified in claim 5 wherein said joist engaging seal member comprises a shoulder which conforms to a corner of the joist.

* * * * *